US008814318B2

(12) United States Patent
Sarkisian et al.

(10) Patent No.: US 8,814,318 B2
(45) Date of Patent: Aug. 26, 2014

(54) PRINTING METHOD WITH PRE-TREATMENT COMPOSITION

(75) Inventors: George Sarkisian, San Diego, CA (US); Ali Emamjomeh, San Diego, CA (US); Blair A. Butler, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/695,234

(22) PCT Filed: Feb. 23, 2011

(86) PCT No.: PCT/US2011/025796

§ 371 (c)(1), (2), (4) Date: Oct. 29, 2012

(87) PCT Pub. No.: WO2011/159370

PCT Pub. Date: Dec. 22, 2011

(65) Prior Publication Data

US 2013/0044157 A1 Feb. 21, 2013

Related U.S. Application Data

(63) Continuation-in-part of application No. 13/639,492, filed as application No. PCT/US2010/038562 on Jun. 14, 2010.

(51) Int. Cl.
*B41J 2/015* (2006.01)

(52) U.S. Cl.
USPC ..... 347/21

(58) Field of Classification Search
CPC ..... C09D 11/00; C09D 11/005; C09D 11/54; B41J 11/15; B41J 2/2107; B41J 2/2117; B41M 5/0017; B41M 5/0011; B41M 5/0023; B41M 7/0018; B05D 1/34; B05D 1/36; B05D 3/002
USPC ..... 347/21
See application file for complete search history.

(56) References Cited

U.S. PATENT DOCUMENTS 5,965,257 A 10/1999 Ahluwalia
6,207,258 B1 * 3/2001 Varnell ..... 428/32.1

(Continued)

FOREIGN PATENT DOCUMENTS

CN 101535424 9/2009
EP 1391312 2/2004

(Continued)

OTHER PUBLICATIONS

International Search Report and Written Opinion for PCT/US2011/025796 dated Nov. 30, 2011 (9 pages).

(Continued)

*Primary Examiner* — Alessandro Amari
*Assistant Examiner* — Michael Konczal

(57) ABSTRACT

Pre-treatment composition and printing method, for producing durable images, using it are disclosed. Said pre-treatment composition includes a liquid vehicle, a polyvalent metal salt as fixing agent, and a latex resin having a glass transition temperature (Tg) ranging from −22° C. to 20° C. Said method encompasses applying the pre-treatment composition onto a recording medium and applying an ink composition including an aqueous liquid vehicle and a colorant, over said pre-treatment composition, wherein the time interval between the finishing point of the application of the pre-treatment composition and between the starting point of the application of the ink composition is between 1 and 30 seconds.

12 Claims, 1 Drawing Sheet

(56) References Cited

U.S. PATENT DOCUMENTS

| | | | | |
|---|---|---|---|---|
| 6,740,689 | B1 | 5/2004 | Lee et al. | |
| 6,786,588 | B2 | 9/2004 | Koyano et al. | |
| 6,906,019 | B2 | 6/2005 | Nitzan et al. | |
| 7,105,260 | B2 | 9/2006 | Terauchi et al. | |
| 7,354,476 | B2 | 4/2008 | Beach et al. | |
| 2003/0018101 | A1 | 1/2003 | Botros et al. | |
| 2004/0139566 | A1 | 7/2004 | Szymanski | |
| 2006/0203056 | A1 | 9/2006 | Furukawa et al. | |
| 2007/0056118 | A1 | 3/2007 | Ellis | |
| 2007/0067928 | A1 | 3/2007 | Ellis | |
| 2007/0216742 | A1 | 9/2007 | Sarkisian et al. | |
| 2007/0225401 | A1 | 9/2007 | Sarkisian et al. | |
| 2008/0092309 | A1 | 4/2008 | Ellis et al. | |
| 2008/0108750 | A1* | 5/2008 | Terada et al. | 525/54.23 |
| 2009/0233061 | A1* | 9/2009 | Irita | 428/195.1 |
| 2009/0233068 | A1 | 9/2009 | Irita | |
| 2010/0075045 | A1 | 3/2010 | Kaimoto et al. | |
| 2010/0214352 | A1 | 8/2010 | Tsunoda et al. | |

FOREIGN PATENT DOCUMENTS

| | | |
|---|---|---|
| JP | 2002079739 | 3/2002 |
| JP | 2005074655 | 3/2005 |
| JP | 2006159426 | 6/2006 |
| JP | 2008266853 | 11/2008 |
| JP | 2009149774 | 7/2009 |
| JP | 2009299240 | 12/2009 |
| JP | 2010046945 | 3/2010 |
| JP | 2010069870 | 4/2010 |
| JP | 2011168911 | 9/2011 |
| WO | WO 99/06219 | 2/1999 |
| WO | WO 2008/033569 | 3/2008 |
| WO | WO-2008052962 | 5/2008 |
| WO | WO 2009/143233 | 11/2009 |

OTHER PUBLICATIONS

Supplementary European Search Report for S.N. PCT/US2010/038562 dated Aug. 6, 2013 (7 pages).

Supplementary European Search Report for S.N. PCT/US2011/025796 dated Aug. 6, 2013 (9 pages).

Supplementary European Search Report for S.N. PCT/US2011/025802 dated Sep. 2, 2013 (9 pages).

The Notification Of The First Office Action for CN Application No. 201080066665.2 dated Oct. 22, 2013.

* cited by examiner

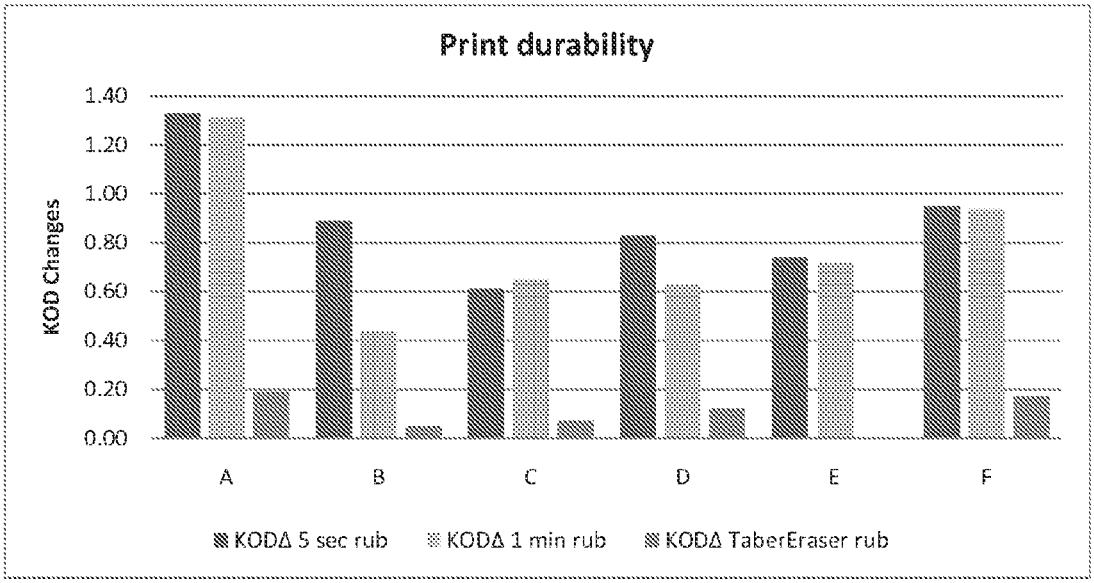
Print durability
KOD Changes
1.40
1.20
1.00
0.80
0.60
0.40
0.20
0.00
A
B
C
D
E
F
KODΔ 5 sec rub
KODΔ 1 min rub
KODΔ TaberEraser rub

PRINTING METHOD WITH PRE-TREATMENT COMPOSITION

CROSS REFERENCE TO RELATED APPLICATIONS

This application is a continuation-in-part of U.S. patent application Ser. No. 13/639,492, filed Oct. 4, 2012, which is itself a U.S. National Stage Entry under 35 U.S.C. §371 of International Application Serial No. PCT/US2010/038562, filed Jun. 14, 2010, which application is incorporated by reference herein in its entirety.

BACKGROUND

Inkjet technology has expanded its application to high-speed, commercial and industrial printing, in addition to home and office usage. Inkjet printing is a non-impact printing method in which an electronic signal controls and directs droplets or a stream of ink that can be deposited on a wide variety of substrates. Current inkjet printing technology involves forcing the ink drops through small nozzles by thermal ejection, piezoelectric pressure or oscillation, onto the surface of a media. This technology has become a popular way of recording images on various media surfaces, particularly paper, for a number of reasons, including, low printer noise, capability of high-speed recording and multi-color recording.

Though there has been great improvement in inkjet printing, improvements are followed by increased demands from consumers specifically regarding higher speeds, higher resolution increased stability, and durability. The ink composition is an important factor that helps to obtain good printing performances. However, in addition to ink composition, a pre-treatment composition can be applied before an ink composition is established on the print recording medium in view of improving printing characteristics and attributes of the image. Such pre-treatment composition is often a substantially colorless liquid that interacts with the colorant and/or with polymeric components of the ink composition to thereby precipitate or, otherwise, fix the ink composition to the print media surface. Pre-treatment formulations and their use are therefore desirable to have more stable and reliable pre-treatment compositions that will produce higher quality print images on the print media surfaces.

BRIEF DESCRIPTION OF THE DRAWING

In order to better understand the present disclosure, some embodiments will be described below by way of non-limiting examples only, with reverence to figures, wherein FIG. 1 is a chart representing black optical density changes of inkjet printing media printed with different pre-treatment compositions according to embodiments of the present disclosure.

DETAILED DESCRIPTION

Before particular embodiments of the present invention are disclosed and described, it is to be understood that the present disclosure is not limited to the particular process and materials disclosed herein. It is also to be understood that the terminology used herein is used for describing particular embodiments only and is not intended to be limiting, as the scope of the present invention will be defined only by the claims and equivalents thereof. In describing and claiming the present composition and method, the following terminology will be used: the singular forms "a", "an", and "the" include plural referents unless the context clearly dictates otherwise. Thus, for example, reference to "a pigment" includes reference to one or more of such materials. Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight range of approximately 1 wt % to about 20 wt % should be interpreted to include not only the explicitly recited concentration limits of 1 wt % to about 20 wt %, but also to include individual concentrations such as 2 wt %, 3 wt %, 4 wt %, and sub-ranges such as 5 wt % to 15 wt %, 10 wt % to 20 wt %, etc. Wt % means herein percentage by weight. All percents are by weight unless otherwise indicated. As used herein, "image" refers to marks, signs, symbols, figures, indications, and/or appearances deposited upon a material or substrate with either visible or an invisible ink composition. Examples of an image can include characters, words, numbers, alphanumeric symbols, punctuation, text, lines, underlines, highlights, and the like.

In some embodiments, the present disclosure refers to a printing method for producing durable images onto a recording medium. In some other embodiments, the present disclosure refers also to the pre-treatment composition used in said method. The method encompasses applying a pre-treatment composition onto a recording medium, said pre-treatment composition containing a liquid vehicle, a polyvalent metal salt as fixing agent, and a latex resin having a glass transition temperature (Tg) ranging from −22° C. to 20° C., and then applying an ink composition containing an aqueous liquid vehicle and a colorant, over said pre-treatment composition. Within such method, the time interval between the finishing point of the application of the pre-treatment composition on the recording medium and between the starting point of applying the ink composition is between 1 and 30 seconds. In some examples, the printing method for producing durable images includes depositing a pre-treatment composition on a recording medium, then jetting an aqueous ink composition that will react with the pre-treatment composition liquid. In some other examples, the pre-treatment composition is applied onto said recording medium using coating devices and the ink composition is jetted onto said recording medium via inkjet nozzles.

It is admitted that the pre-treatment composition, upon contact with ink, may cause the colorants present in the ink formulation to precipitate out and result in the enhancement of image quality attributes, as for example, optical density, chroma, and durability. Indeed, without being linked by any theory, it is believed that after the pre-treatment composition is overprinted with the ink composition on the substrate or, in other words, when ink and pre-treatment composition meet on the media surface, an effective immobilization of ink colorants is realized and nearly all the colorants are deposited on the surface of the media rather than penetrating the media and depositing below the surface. Concurrently, the pre-treatment composition vehicle, upon mixing with the ink vehicle, becomes highly wetting and the mixed vehicle quickly penetrates the media, leaving the colorants behind. Within such printing method, the combination of pre-treatment composition and ink composition provide thus high quality and durable image prints. Therefore, the use of the pre-treatment composition such as disclosed herein results in the enhancement of image quality attributes while enabling variable and high-speed printing. In some example, the ink composition overprints the pre-treatment composition. Such printing method results in printed media that have good durability performance, as well as reduce bleeding and coalescence issues. As durability performance, it is meant herein that the use of pre-treatment composition provides robustness to dry finishing as well as durability. In addition, the image forming method described herein produces printed images of high quality and enables high-speed printing.

The printing method provides printed image having, in the same time, good image quality and durability. In some examples, the printing method is particularly effective on slow-absorbing recording medium, such as coated offset media. In some examples, the pre-treatment composition such as described herein and the printing method using said pre-treatment composition enable high-speed inkjet printing and provide printed images with excellent bleed, coalescence and superior durability, specifically when the web speed varies from 50 to 2000 fpm.

In some embodiments, the print delay time of the printing method for producing durable images such as defined herein is between 1 and 30 seconds. By "print delay time", it is meant herein the time interval between the finishing point of the application of the pre-treatment composition and between the starting point of the application of the ink composition. In some other embodiments, the time interval between the finishing point of the application of the pre-treatment composition on the recording medium and between the starting point of the application of the ink composition, i.e. the print delay time is between 5 and 30 seconds.

Without being linked by any theory, it is believed that such print delay time, should be sufficient in view of allowing the proper mix of the pre-treatment composition and of the ink composition jetted on it, in view of obtaining mix that solidify slowly enough in view of providing printed image with excellent durability performances. Such print delay time is often dependant of the web speed. For examples, for web speeds of 100 fpm or less, the print delay time could be several of seconds. Thus, in some examples, the aqueous ink composition is jetted onto a recording medium just after, at least, 5 seconds of the application of the pre-treatment composition, while the pre-treatment composition is still wet on the recording medium, ensuring a proper mixture between the aqueous ink composition and the pre-treatment composition.

In some embodiments, the present disclosure relates to a printing method for producing durable images onto a recording medium by applying a pre-treatment composition that enables inkjet applications for web printing at variable speeds, from 50 to 2000 fpm. In some examples, the printing method for producing durable inkjet ink images is a high-speed printing method. By high-speed, it is meant herein a method capable of printing more than 50 of feet per minute (fpm) and up to 2000 fpm. The printing method can also be a printing method capable of printing from about 50 to about 800 feet per minute, the print speed (or web speed) of the printing method ranges from about 50 to about 800 feet per minute. In some examples, the printing method is a printing method capable of printing from about 50 to about 400 feet per minute, the print speed (or web speed) of the printing method ranges from about 50 to about 400 feet per minute. In some other examples, the printing method is a printing method capable of printing from about 50 to about 200 feet per minute, the print speed (or web speed) of the printing method ranges from about 50 to about 200 feet per minute. In yet some other examples, the printing method of the present disclosure is a printing method capable of printing more than 100 of feet per minute (fpm), the print speed (or web speed) of the printing method is thus more than about 100 fpm.

In some embodiment, the print speed (or web speed) of the printing method ranges from about 50 to about 200 feet per minute and the time interval between the finishing point of the application of the pre-treatment composition and between the starting point of the application of the ink composition, i.e. the print delay time, is between 5 and 30 seconds. In some other embodiments, the printing method for producing durable images onto a recording medium encompasses applying a pre-treatment composition onto a recording medium containing a liquid vehicle, a polyvalent metal salt as fixing agent, and a latex resin having a glass transition temperature (Tg) ranging from about −3° C. to about +7° C.; and then applying an ink composition over said pre-treatment composition, wherein the time interval between the finishing point of the application of the pre-treatment composition on the recording medium and between the starting point of applying the ink composition is between 1 and 30 seconds and wherein the print speed of the printing method is from about 50 to about 400 feet per minute. In yet some other embodiments, the printing method for producing durable images onto a recording medium encompasses applying a pre-treatment composition onto a recording medium containing a liquid vehicle, a polyvalent metal salt as fixing agent, and a latex resin having a glass transition temperature (Tg) ranging from about −3° C. to about +7° C.; and then applying an ink composition over said pre-treatment composition, wherein the time interval between the finishing point of the application of the pre-treatment composition and between the starting point of applying the ink composition is between 5 and 30 seconds and wherein the print speed of the printing method is from about 50 to about 200 feet per minute.

In some examples, at a web speed of 50 fpm, the print delay time between application of the pre-treatment fluid and of the ink composition could be 5 seconds or longer. In some other examples, at faster web speeds (more than 50 fpm), the time between pretreatment application and printing could be less than 5 seconds. In some examples, the printing method is well suited for high speeds industrial and for commercial printing. In some other examples, the printing method is well adapted for in-line and high through put printing applications.

In some examples, the printing method for producing durable images is an inkjet printing method. By inkjet printing method, it is meant herein a method wherein a stream of droplets of ink is jetted onto a recording substrate or medium to form the desired printed image. The ink composition may be established on the recording medium via any suitable inkjet printing technique. Examples of inkjet method include methods such as a charge control method which uses electrostatic attraction to eject ink, a drop-on-demand method which uses vibration pressure of a piezo element, an acoustic ink jet method in which an electric signal is transformed into an acoustic beam and ink is irradiated with the acoustic beam so as to be ejected by radiation pressure, and a thermal inkjet method which uses pressure caused by bubbles formed by heating ink. Non-limitative examples of such inkjet printing techniques include thus thermal, acoustic, and piezoelectric inkjet printing. In some examples, the ink composition is jetted onto the recording medium using an inkjet nozzle and/or an inkjet printhead. In some other examples, the ink composition is jetted onto the recording method using thermal inkjet printheads.

In some examples, the printing method for producing durable images includes applying the pre-treatment composition onto a recording medium using coater or coating devices and jetting an ink composition onto said recording medium via inkjet nozzles. The coater is not particularly limited and can be appropriately selected from known coaters according to the intended use. Examples of coater include an air doctor coater, a blade coater, a rod coater, a knife coater, a squeeze coater, an impregnation coater, a reverse roll coater, a transfer roll coater, a gravure coater, a kiss-roll coater, a cast coater, a slot die coater, a spray coater, a curtain coater, and an extrusion coater. Details of the method may be referenced in "Coating Kogaku (Coating Engineering)", by Yuji Harasaki. In some example, the coater is a transfer roll coating device. In order to apply the pre-treatment composition to the recording medium with a uniform thickness, an air-knife may be used for the coating or a member having an acute angle may be positioned with a gap corresponding to the predetermined amount of pre-treatment composition, between the member and the recording medium. The application of the pre-treatment composition may also be done by any known commercial methods such as gravure, inkjet method, spray coating method, and roller coating method. In some example, the pre-treatment composition is applied by a coating method using rollers. Thus, the pre-treatment composition may be rolled on the recording medium using commercial roll coating equipment. Examples of method for printing durable inkjet ink images onto a recording medium includes thus applying the pre-treatment composition onto the recording medium with rollers or transfer roll coating devices. In some examples, a set of more than 3 rollers can be used. In some other examples, the printing method uses about up to 30 rollers. As an example, within such method, the pre-treatment composition is received onto a first surface, and then a contact is formed between the first surface and a transfer roll. The pre-treatment composition is then transferred from the first surface to the transfer roll. Finally, the pre-treatment composition is transferred from the transfer roller to a print medium. In one approach, the pre-treatment composition is applied to a print recording medium just before the printing of inks by printheads. According to this method, one or several rollers receive the pre-treatment composition and transfer it to a print medium. Thereafter, the print media receives inkjet ink from one or more inkjet printheads.

In some examples, the pre-treatment composition is applied to a recording medium using coating devices and, subsequently, the ink is jetted by inkjet nozzles to record an image. Said inkjet ink composition includes an aqueous liquid vehicle and a colorant, wherein the inkjet ink overprint said pre-treatment composition. In some examples, the ink composition is applied to the recording medium using inkjet nozzles, and is applied after the application of the pre-treatment composition.

In some examples, the printing method may further include a drying process in which the solvent (especially water) present in the ink composition is removed by drying. Thus, in some examples, as a further step, the recording medium is submitted to a hot air drying systems. Alternatively, or in combination with the drying process, a process may be provided in which the solvent in the ink is removed by absorbing the solvent by contacting a roller made of a porous material or the like with the surface of the recording medium. Further, a fixing process may be provided in which the image formed on the recording medium is fixed by at least one of a pressure-application means that applies.

In some examples, the ink composition is established on at least a portion of the recording medium to form an image. The pre-treatment composition may be readily applied to the almost entire area of recording side of the recording medium, including an image portion to which ink droplets is to be applied by ink ejection unit. In some example, the pre-treatment composition is established below the ink composition. The amount of pre-treatment composition and/or ink composition used depends, at least in part, on the desirable image to be formed.

In some embodiments, the present disclosure relates to a pre-treatment composition, for use in a method for printing durable images such as defined herein, containing a liquid vehicle, a polyvalent metal salt as fixing agent and a latex resin having a glass transition temperature (Tg) ranging from −22° C. to 20° C. Such pre-treatment composition is used as a fixing fluid composition. The "pre-treatment composition" or "fixing fluid composition" contains an aqueous vehicle and an effective amount of one or more fixing agents. A fixing agent is an ingredient that initiates a change in the solubility or stability of the colorant and fixes the colorant in place in the printed image. An "effective amount" of fixing agents is an amount that is effective in achieving an improvement in print quality, e.g., decreased coalescence, strikethrough and bleed, increased optical density (OD), chroma, edge acuity, and good drip and smear fastness, as compared to a print that has not been fixed. The pre-treatment composition can be formulated for high spread and quick penetration and drying. The surface tension can be less than about 45 mN/m. The pre-treatment composition is a stable composition, meaning thus that the pre-treatment composition does not present stability problems over time. In some embodiments, the use of the pre-treatment composition results in printed image having, at the same time, good image quality and durability. In some other embodiments, the use of the pre-treatment composition is particularly effective on slow-absorbing media, such as coated offset media.

In some examples, the pre-treatment composition has a viscosity within the range of about 1.0 to about 2000 cps, and, in other examples, of about 10 to about 1000 cps. In yet other examples, pre-treatment composition has a viscosity within the range of about 40 to about 100 cps as measured at 25° C., in order to achieve the desired rheological characteristics. As indicated above, the viscosity of the composition is conveniently regulated, for instance, by suitable choice of the quantity and the molecular weight of the binders resin, the organic solvent, and other agents.

In some embodiments, the pre-treatment composition includes latex resin components. Such latex resin components have a glass transition temperature (Tg) ranging from −22° C. to +20° C. In some other embodiments, the latex resin components have a glass transition temperature (Tg) ranging from −3° C. to +7° C. The way of measuring the glass transition temperature (Tg) parameter is described in, for example, Polymer Handbook, 3rd Edition, authored by J. Brandrup, edited by E. H. Immergut, Wiley-Interscience, 1989. Without being linked by any theory, it is believed that the print delay time of the printing method is affected by the glass transition temperature (Tg) of the latex resin components. Specifically, it was ascertained that the Tg value of the latex resin components had an effect on the durability of the resulting printed image. In other words, if the Tg value of the resin is too low or is too high, the durability of the printed media tend not to be good. In some examples, the latex resin has a glass transition temperature (Tg) ranging from −22° C. to +20° C., in view of accommodating changes in web speed. Without being linked by any theory, it is believed that these Tg help to have adequate wet-on-wet mixing of the pretreatment fluid and of the ink by modulating the film forming rate of the resin/ink mixture. Indeed, it was observed that latex resin with a glass transition temperature (Tg) below −22° C. starts to form a film too fast when the web speed is slow (50 fpm). Resin stratification occurs after 5 seconds, resulting thus in a poor mixing with the ink. Therefore, by adjusting the Tg of the resin, the film is formed at the right time to capture the ink; very durable prints can thus be generated at any web printing speed (50 to 2000 fpm). In addition, it is believed that, when the time interval between the finishing point of the application of the pre-treatment composition and between the starting point of the application of the ink composition is 5 seconds or more and when the latex resin has a glass transition temperature (Tg) below −22° C., the resin forms a film too fast to capture and mix with the ink, resulting therefore in print quality that does not have a good print quality and a good durability. Thus, when using resins with glass transition temperature (Tg) ranging from −22° C. to 20° C., the pre-treatment composition containing it will coalesce in a slower way and will capture the ink better, leading therefore to printed image having have good print quality and durability.

The polymeric latex resin can be a cationic, an anionic or an amphoteric polymeric latex resin. In some examples, the latex resin is an anionic polymeric latex resin. The term latex refers herein to a group of preparations consisting of stable dispersions of polymeric micro-particles dispersed in an aqueous matrix. In some examples, the latex resin is present, in the composition, in the form of dispersed latex resin particles. In some embodiments, the pre-treatment composition contains a latex resin having an acid number of less than 20. In some other embodiments, the latex resin has an acid number of less than 18. As used herein, the acid number (AN) refers to the number that has been measured by conductivity titration of the latent acid functions of the latex resin with nitric acid. As an example, the sample is made strongly basic with KOH then is titrated with 1% of $HNO_3$. The pH and conductivity curves are measured simultaneously. In some examples, the latex resin is a resin made of polymer and copolymer selected from the group consisting of acrylic polymers or copolymers, vinyl acetate polymers or copolymers, polyester polymers or copolymers, vinylidene chloride polymers or copolymers, butadiene polymers or copolymers, styrene-butadiene polymers or copolymers, acrylonitrile-butadiene polymers or copolymers. In some other examples, the latex resin component is a latex containing particles of a vinyl acetate-based polymer, an acrylic polymer, a styrene polymer, an SBR-based polymer, a polyester-based polymer, a vinyl chloride-based polymer, or the like. In yet some other examples, the latex resin is a polymer or a copolymer selected from the group consisting of acrylic polymers, vinyl-acrylic copolymers and acrylic-polyurethane copolymers.

The latex resin may have an average molecular weight (Mw) of about 5,000 to about 500,000. In some examples, the latex resin has an average molecular weight (Mw) ranging from about 150,000 to about 300,000. In some other examples, the latex resin has an average molecular weight of about 250,000. The average particle diameter of the latex resin particles can be from about 10 nm to about 1 μm; in some other examples, from about 10 to about 500 nm; and, in yet other examples, from about 50 nm to about 250 nm. The particle size distribution of the latex is not particularly limited, and either latex having a broad particle size distribution or latex having a mono-dispersed particle size distribution may be used. It is also possible to use two or more kinds of polymer fine particles each having a mono-dispersed particle size distribution in combination. In some embodiments, the latex resin, present in the pre-treatment composition, has a glass transition temperature ranging from −22° C. to +20° C. and has an acid number of less than 20. In some other embodiments, the latex resin components has a glass transition temperature ranging from −3° C. to +7° C. and an acid number of less than 20.

In some examples, the latex resin is present in the pre-treatment composition in an amount representing from about 1 to about 70 wt % of the total weight of the pre-treatment composition. In some other examples, the latex resin is present in an amount representing from about 10 to about 60 wt % of the total weight of the pre-treatment composition. In yet some other examples, the latex resin is present in an amount representing from about 20 to about 50 wt % of the total weight of the pre-treatment composition. The latex resin may include, but is in no way limited to latex resins sold under the name Hycar® or Vycar® (from Lubrizol Advanced Materials Inc.); Rhoplex® (from Rohm & Hass company); Neocar® (from Dow Chemical Comp); Aquacer® (from BYC Inc) or Lucidene® (from Rohm & Haas company).

In some examples, the pre-treatment composition includes, as a fixing agent, a polyvalent metal salt. The polyvalent metal salt component can be a divalent or a higher polyvalent metallic ion and anion. In some examples, the polyvalent metal salt component is soluble in water. Examples of polyvalent metallic ions include divalent metallic ions, such as $Ca^{2+}$, $Cu^{2+}$, $Ni^{2+}$, $Mg^{2+}$, $Zn^{2+}$ and $Ba^{2+}$; trivalent metallic ions, such as $Al^{3+}$, $Fe^{3+}$ and $Cr^{3+}$. In some other examples, the polyvalent metallic ion is selected from the group consisting of $Ca^{2+}$, $Mg^{2+}$ or $Zn^{2+}$. In yet some other examples, the polyvalent metallic ions are $Ca^{2+}$. Examples of anions include $Cl^-$, $I^-$, $Br^-$, $NO_3^-$ or $RCOO^-$ (where R is H or any hydrocarbon chain). The polyvalent metal salt anion can be a chloride ($Cl^-$) or acetate ($CH_3COO^-$). In some examples, the polyvalent metal salt is composed of divalent or polyvalent metallic ions and of nitrate or carboxylate ions. The carboxylate ions are derived from a saturated aliphatic monocarboxylic acid having 1 to 6 carbon atoms or a carbocyclic monocarboxylic acid having 7 to 11 carbon atoms. Examples of saturated aliphatic monocarboxylic acid having 1 to 6 carbon atoms include formic acid, acetic acid, propionic acid, butyric acid, isobutyric acid, valeric acid, isovaleric acid, pivalic acid and hexanoic acid. In some examples, the fixing agent is a polyvalent metal salt selected from the group consisting of calcium chloride, calcium nitrate, magnesium nitrate, magnesium acetate or zinc acetate. In some other examples, the polyvalent metal salt is calcium chloride or calcium nitrate ($CaCl_2$ or $Ca(NO_3)_2$). In yet some other examples, the polyvalent metal salt is calcium chloride ($CaCl_2$). The fixing agent can be present in the pre-treatment composition in an amount representing from about 1 to about 20 wt % of the total weight of the pre-treatment composition. In some other examples, the fixing agent is present in an amount representing from about 3 to about 15 wt % of the total weight of the pre-treatment composition. In yet some other examples, the fixing agent is present in an amount representing from about 7 to about 9 wt % based on the total weight of the pre-treatment composition.

The pre-treatment composition can contain surfactants. Non-limiting examples of suitable surfactants include nonionic surfactant, cationic surfactant and combinations thereof. In some other examples, the surfactants are nonionic surfactants. In yet some other examples, the surfactants are nonionic surfactants selected from the group consisting of nonionic fluorosurfactant, nonionic acetylenic diol surfactant, nonionic ethoxylated alcohol surfactant and combinations thereof. In a non-limitative example, the pre-treatment composition contains nonionic ethoxylated alcohol surfactant. Several commercially available nonionic surfactants may be used in the formulation of the pre-treatment composition, examples of which include ethoxylated alcohols such as those from the Tergitol® series (e.g., Tergitol® 15S30, Tergitol® 15S9), manufactured by Dow Chemical; surfactants from the Surfynol® series (e.g. Surfynol® 440 and Surfynol® 465), manufactured by Air Products and Chemicals, Inc.; fluorinated surfactants, such as those from the Zonyl® family (e.g., Zonyl® FSO and Zonyl® FSN surfactants), manufactured by E.I. DuPont de Nemours and Company; fluorinated PolyFox® nonionic surfactants (e.g., PF159 nonionic surfactants), manufactured by Omnova; or combinations thereof. Suitable cationic surfactants that may be used in the pre-treatment composition include long chain amines and/or their salts, acrylated diamines, polyamines and/or their salts, quaternary ammonium salts, polyoxyethylenated long-chain amines, quaternized polyoxyethylenated long-chain amines, and/or combinations thereof. Surfactants can be present in the pre-treatment composition in an amount up to about 1.5 weight percentage (wt %). As a non-limiting example, surfactants are present in an amount ranging from about 0.1 wt % to about 1 wt %. In still another non-limiting example, the surfactants are present in an amount ranging from about 0.2 wt % to about 0.6 wt %.

In some examples, the pre-treatment composition includes an aqueous vehicle. The term "aqueous vehicle," as defined herein, refers to the aqueous mix in which the fixing agent is placed to form the pre-treatment composition. Examples of suitable aqueous vehicle components include, but are not limited to, water, co-solvents, surfactants, additives (corrosion inhibitors, salts, etc.), and/or combinations thereof. In some examples, the aqueous vehicle includes a water soluble organic co-solvent, a surfactant, and water. Non-limiting examples of the water soluble organic co-solvent include 2-ethyl-2-hydroxymethyl-1,3-propanediol, glycerol propoxylate, tripropylene glycol, 1-(2-hydroxyethyl)-2-pyrrolidinone, 1-(2-hydroxyethyl)-2-imidazolidinone, and/or combinations thereof. Examples of other suitable solvents include amine-N-oxide, ethylene glycol, diethylene glycol, triethylene glycol, 1-propoxy-2-propanol (commercially available as Dowanol® PNP from The Dow Chemical Co., Midland, Mich.), and combinations thereof. In some examples, an organic co-solvent is present in the pre-treatment composition in an amount up to about 25 wt %; in some other examples, in an amount of from about 0 wt % to about 20 wt %. One or more additives may also be incorporated into the pre-treatment composition. As used herein, the term "additive" refers to a constituent of the fluid that operates to enhance performances, environmental effects, aesthetic effects, or other similar properties of the composition. Examples of suitable additives include biocides, sequestering agents, chelating agents, anti-corrosion agents, dyes, optical whiteners, brighteners, and/or the like, and/or combinations thereof. In some examples, the pre-treatment composition includes a marker dye such as, for example, Basic Violet 16 (BV 16). In some examples, the additives are present in the pre-treatment composition in an amount ranging from about 0.01 wt % to about 1 wt %.

As an illustrative example, the recording medium or substrate used in the printing method defined herein is paper (non-limitative examples of which include plain copy paper or papers having recycled fibers therein), plain offset printing papers in roll form or photo-paper, and/or combinations thereof. In some examples, the recording medium has a thickness along substantially the entire length ranging between about 0.025 mm and about 0.5 mm. In some examples, the recording medium is a coated offset media. In some other examples, the recording medium is a non-porous recording medium. The recording medium can be an absorptive medium. The absorptive medium can be a slow-absorbing medium, such as coated offset media; or can be a fast-absorbing medium such as plain paper. In some examples, the recording medium used in the present printing method, is a slow-absorbing medium. In some other examples, the recording medium is a slow-absorbing, non-porous, recording medium.

In some examples, the ink composition used in the method for printing durable images onto a recording medium is an inkjet ink composition. In some other examples, the ink composition is an aqueous inkjet ink composition. Said ink composition includes an aqueous liquid vehicle and a colorant. In some examples, the colorant is selected from a yellow colorant, a magenta colorant, a cyan colorant and a black colorant, and the ink vehicle includes at least one solvent present in an amount ranging from about 1 to about 25 wt %; at least one surfactant present in an amount ranging from about 0.1 to about 8 wt %; at least one polymer present in an amount ranging from about 0 to about 6 wt %; at least one additive present in an amount up to about 0.2 wt %; and water. The colorant for each ink is selected from a pigment, a dye or combinations thereof. In some examples, the ink contains pigments as colorants. As used herein, "pigment" refers to a colorant particle that is substantially insoluble in the liquid vehicle in which it is used. Pigments can be dispersed using a separate dispersing agent, or can be self-dispersed, having a dispersing agent attached to the surface of the pigment. As used herein, "self-dispersed" generally refers to pigments that have been functionalized with a dispersing agent, such as by chemical attachment of the dispersing agent to the surface of the pigment. The dispersing agent can be a small molecule or a polymer or oligomer. The pigments include both self-dispersed pigments as well as dispersed pigments, e.g., pigments dispersed by a separate dispersing agent that is not covalently attached to the surface. In one example, the pigments are not self-dispersing, and a dispersing aid may be added to the vehicle. In another example, the pigments are self-dispersable and modified to include at least one polymer chemically attached thereto.

As alluded to, pigment colorant can be used in accordance with embodiments of the present disclosure. Specifically, if black is used, the black pigment can be any commercially available black pigment that provides acceptable optical density and print characteristics. Such black pigments can be manufactured by a variety of known methods such as channel methods, contact methods, furnace methods, acetylene methods, or thermal methods, and are commercially available from such vendors as Cabot Corporation, Columbian Chemicals Company, Evonik, Mitsubishi, and E.I. DuPont de Nemours and Company. In addition to black, other pigment colorants can be used, such as cyan, magenta, yellow, blue, orange, green, pink, etc. Suitable organic pigments include, for example, azo pigments including diazo pigments and monoazo pigments, polycyclic pigments (e.g., phthalocyanine pigments such as phthalocyanine blues and phthalocyanine greens, perylene pigments, perynone pigments, anthraquinone pigments, quinacridone pigments, dioxazine pigments, thioindigo pigments, isoindolinone pigments, pyranthrone pigments, and quinophthalone pigments), insoluble dye chelates (e.g., basic dye type chelates and acidic dye type chelate), nitropigments, nitroso pigments, anthanthrone pigments such as PR168, and the like. In some examples, the amount of colorant present in the ink compositions ranges from about 2.0 wt % to about 4.5 wt %. It is to be understood however, that the colorant loading may be more or less, as desired.

As defined herein, an "ink vehicle" refers to the vehicle in which the colorant is placed to form the ink. Non-limiting examples of suitable components for the ink vehicle include water-soluble polymers, anionic polymers, surfactants, solvents, co-solvents, buffers, biocides, sequestering agents, viscosity modifiers, surface-active agents, chelating agents, resins, and/or water, and/or combinations thereof. Suitable solvents for the ink vehicle include, but are not limited to glycerol polyoxyethyl ether, tripropylene glycol, tetraethylene glycol, 1-(2-hydroxyethyl)-2-imidazolidinone, 1-(2-hydroxyethyl)-2-pyrrolidone, 1,6-hexanediol, 1,2,6-hexanetriol, trimethylolpropane, dipropylene glycol, Dantocol® DHE (Lonza Inc., Fairlawn N.J.), and/or combinations thereof. In a non-limiting example, the solvents are present in the ink vehicle in an amount ranging from about 1 wt % to about 25 wt %. In some examples, the ink composition includes water. In some examples, water is used as the ink carrier for the composition and is part of the liquid vehicle. In some other examples, the water makes up the balance of the ink composition, and may be present in an amount representing from about 40 to about 90 weight percentages or representing from about 50 to about 80 weight percentages by weight of the total composition. The surfactants for the ink vehicle can be nonionic or anionic. Suitable nonionic surfactants include, but are not limited to ethoxylated alcohols, fluorinated surfactants, 2-diglycol surfactants, and/or combinations thereof. Specific examples of nonionic surfactants include surfactants from the Surfynol® series (e.g., Surfynol® CT211, Surfynol® SEF), manufactured by Air Products and Chemicals, Inc., in addition to the surfactants (e.g., Tergitol®) provided hereinabove for the aqueous vehicle of the fixer. Non-limiting examples of suitable anionic surfactants for the ink vehicle include those anionic surfactants of the Dowfax® family (e.g., Dowfax® 8390), manufactured by Dow Chemical Company, located in Midland, Mich., or anionic Zonyl® surfactants (e.g., Zonyl® FSA), manufactured by E.I. DuPont de Nemours and Company; phosphate ester surfactants including the surfactants of the Emphos® series and the DeDophoS® series, both manufactured by Witco Corp., Middlebury, the surfactants of the Crodafos® series, manufactured by Croda Inc., Edison, N.J., the surfactants of the Dephotrope® series and of the DePHOS® series, both manufactured by DeForest Enterprises Inc., Boca Raton, Fla.; alkyl sulfates (e.g., lauryl sulfate), alkyl ether sulfates (e.g., sodium laureth sulfate); N-lauroyl sarcosinate; dodecylbenzene sulfonate; and/or combinations thereof. In some examples, the ink vehicle includes one or more surfactants present in an amount up to about 8 wt %, with other non-limiting examples including from about 0.1 wt % to about 6 wt % and from about 1.2 wt % to about 2 wt %. In some examples, the ink vehicle can include a polymer present in an amount ranging from about 0.01 wt % to about 4 wt % or in an amount ranging from about 0.1 wt % to about 1.5 wt %. The polymers for the ink vehicle are generally water-soluble, and may be selected from those of the salts of styrene-(meth) acrylic acid copolymers, polystyrene-acrylic polymers, polyurethanes, and/or other water-soluble polymeric binders, and/or combinations thereof. As a non-limiting example, one class of polymeric binders suitable for use in the ink includes salts of styrene-(meth)acrylic acid copolymers. Suitable non-limiting examples of styrene-(meth)acrylic acid copolymers are commercially available and may be selected from the Joncryl® series (e.g., Joncryl® 586 and 683), manufactured by BASF Corp. located in Florham Park, N.J.; SMA-1000Na and SMA-1440K, manufactured by Sartomer, located in Exton, Pa.; Disperbyk 190, manufactured by BYK Chemicals, located in Wallingford, Conn.; polystyrene-acrylic polymers manufactured by Gifu Shellac, located in Japan; or combinations thereof. Additives may also be incorporated into embodiments of the ink vehicle for the inks. As a non-limiting example, bactericides, such as Proxel® GXL, may be added to the ink to protect the ink from bacterial growth. Other suitable additives include, but are not limited to, buffers, biocides, sequestering agents, chelating agents, or the like, or combinations thereof. In some examples, the ink vehicle includes one or more additives present in an amount ranging from about 0.1 wt % to about 0.5 wt %. In other examples, no additives are present.

In some examples, the printing method for producing durable images includes the use of the pre-treatment composition and includes the use of at least an inkjet ink composition selected from a black ink, a yellow ink, a cyan ink, a magenta ink, an orange ink, a red ink, and a green ink. In some examples, at least one ink is deposited into individual printheads. Non-limiting examples of suitable printhead configurations include single printheads, dual chamber printheads, tri-chamber printheads and/or the like, and/or combinations thereof. It is to be understood that any number of colored ink compositions may be used in the method such as described herein. Furthermore, any desirable combination of colored inks may be used. For example, each of the colored ink compositions may be of a different color, or two or more of the inks may be different shades of the same color (i.e., light magenta and dark magenta inks). In some examples, four different colored inks can be used: a black ink, a yellow ink, a cyan ink, and a magenta ink. In some other examples, the method includes the use of any desirable number of inks selected from black ink, yellow ink, cyan ink, magenta ink, orange ink, red ink, green ink, and/or combinations thereof.

As an example, the pre-treatment composition and the ink composition are part of a printing system for printing durable inkjet images. Said printing system includes a pre-treatment composition applicator containing, at least, a transfer roller and a pre-treatment composition, and contains one or several successive inkjet printheads containing inkjet ink composition, said inkjet ink composition including an aqueous liquid vehicle and a colorant. In an example, the inkjet printheads are thermal inkjet printheads. In some examples, the printing system includes a pre-treatment composition applicator containing, at least, a transfer roller and a pre-treatment composition and, at least, four different successive inkjet printheads containing respectively, black, cyan, magenta and yellow inkjet ink compositions. The ink printing system, including the pre-treatment composition of the present disclosure, in addition to black and color inks, presents excellent printing performances and image characteristics.

EXAMPLES

Ingredients and Abbreviations

- Hycar® 2679, Vycar® 460x63 and Vycar® 460x46 are latex resins available from Lubrizol Inc.
- Lucidene 645® is an acrylic urethane polymer available from Rohm & Haas.
- Neocar 2300® is a latex available from Dow Chemical Comp.
- LEG-1 is a co-solvent available from Liponics.
- Zonyl® FSO is a surfactant available from Dupont Inc.
- Cab-O-Jet® 300 is a self dispersed pigment available from Cabot Corporation.
- Joncryl® 586 is a styrene-acrylic binder available from BASF Corp.
- Proxel® GXL is a biocide available from Arch Chemicals Inc.
- Chemguard S-550-L is a fluorosurfactant available from Chemguard.

Example 1

Preparation of Ink Composition

A black inkjet ink composition is prepared in accordance with TABLE 1 below. All percentages are expressed in percentage by weight (wt %) based on the total weight of the ink composition.

TABLE 1

| Component | Amount (wt %) |
|---|---|
| BP 700 Black Pigment | 3.0 |
| Cab-O-Jet ® 300 | 1.0 |
| Joncryrl ® 586 | 1.0 |
| 2-Pyrrolidone | 10.0 |
| LEG-1 | 1.0 |
| Zonyl ® FSO | 0.1 |
| Proxel ® GXL | 0.1 |
| Water | Balance |

Example 2

Preparation of Pre-Treatment Composition

Pre-treatment compositions A, B, C, D, E and F are prepared in accordance with TABLE 2. All percentages are expressed in percentage by weight (wt %) based on the total weight of the pre-treatment composition.

TABLE 2

| Pre-treatment compositions | A | B | C | D | E | F |
|---|---|---|---|---|---|---|
| Lucidene 645 ® | 33.00% | — | — | — | — | — |
| Hycar 2679 ® | — | 33.00% | — | — | — | — |
| Vycar 460X46 ® | — | — | 33.00% | — | — | — |
| Neocar 2300 ® | — | — | — | 33.00% | — | — |
| Vycar 460X63 ® | — | — | — | — | 33.00% | |
| Hycar 26391 ® | — | — | — | — | — | 33.00% |
| 2-Pyrrolidone | 3.00% | — | — | — | — | — |
| Calcium Chloride | 7.00% | 4.00% | 4.00% | 4.00% | 4.00% | 4.00% |
| Chemguard S550L | 0.10% | 0.05% | 0.05% | 0.05% | 0.05% | 0.05% |
| Proxel GXL ® | 0.10% | 0.10% | 0.10% | 0.10% | 0.10% | 0.10% |
| Water | balance | balance | balance | balance | balance | balance |

TABLE 3 below illustrates the different resins used in the pre-treatment compositions A, B, C, D, E and F with their different glass transition temperature (Tg).

TABLE 3

| Resin Tradenames | Tg ° C. |
|---|---|
| Lucidene 645 ® | −22 |
| Hycar 2679 ® | −3 |
| Vycar 460X46 ® | 7 |
| Neocar 2300 ® | 15 |
| Vycar 460X63 ® | 22 |
| Hycar 26391 ® | 36 |

Example 3

Pre-Treatment Composition Performances

Pre-treatment compositions A to F (such as illustrated in TABLE 2) are evaluated for their printing performances, specifically for their durability resistances. The results are illustrated in TABLE 4. Pre-treatment compositions A to F are tested in combination with the black ink of in example 1 (such as illustrated in TABLE 1). The pre-treatment compositions A to F are rolled on with an industrial coating fixture on media. Then, an identical image sequence is printed with black ink having formulation such as illustrated in Example 1, using a HP T-300 web-press. The coat weight for the roll-on pre-treatment is 2 grams/sq meters and is 10 grams/sq meters for black ink printed on top of said pre-treatment formulation. The web speed is 100 fpm; the print delay time (time interval between the finishing point of the application of the pre-treatment composition on the recording medium and between the starting point of applying the ink composition) is 5 seconds.

Resistance tests are performed onto the printed media. The "dry rub resistance" refers to the ability of a printed image to resist appearance degradation upon rubbing the image. Good resistance, upon rubbing, will tend not to transfer ink from a printed image to surrounding areas where the ink has not been printed and the black optical density (KOD) will be maintained.

Different Abrasion Tests are Made:

"Dry Eraser Rub Tests" are performed with an eraser by applying the rub 5 seconds and 1 minute after the print leaves the dryer. The rub tests are conducted with a soft pencil eraser tip and a pressure of between 5 to 7 lbs. The eraser tip is rubbed over the newly pretreated, printed, and dried surface for comparison of immediate drying and durability performance. This same test is used within seconds (1-5) of printing completed and up to 5 minutes after printing is complete.

A "Taber eraser test" is performed with a Taber Linear Abrader using a hard (#10) eraser with a 350 g weight 24 hours after printing. Two cycles are made with the hard eraser in the black area fill print. The KOD is measured before and after the rub. The Taber process shows more handling and abrasion effects on the sample. This test represents the heavy contact between the sample and finishing equipment (i.e. folders, staplers, inserting equipment.)

For each print, before and after the test, the black optical density (KOD) is measured using an X-Rite densitometer to measure the reflectance of the area filled. The higher the KOD value, the darker the black colored image obtained. Black optical density changes of the print media samples are then evaluated (Δ KOD). The numbers herein refer to the difference in optical density (Δ KOD) that has been measured. (The smaller the number is, the better the performance is). The results are illustrated in TABLE 4.

The results are also represented in FIG. 1. FIG. 1 illustrates Black optical density changes (Δ KOD) for the prints, printed with ink and pre-treatment compositions A, B, C, D, E and F (i.e. with pre-treatment compositions having resins with different Tg) after the abrasion test.

TABLE 4

| Pre-treatment compositions | KODΔ (Dry Eraser Rub/5 sec rub) | KODΔ (Dry Eraser 1 min rub) | KODΔ (Taber Eraser rub) |
|---|---|---|---|
| A | 1.33 | 1.31 | 0.19 |
| B | 0.89 | 0.44 | 0.05 |
| C | 0.61 | 0.65 | 0.07 |
| D | 0.83 | 0.63 | 0.12 |
| E | 0.74 | 0.72 | 0.00 |
| F | 0.95 | 0.94 | 0.17 |

Furthermore, the results demonstrate that pre-treatment composition A (Tg−22° C.), when applied onto the media, starts to solidify after about 2 seconds and does not mix adequately with inkjet composition that is applied on top, after that time, to form a durable film. The printed image resulting from the use of pre-treatment composition A presents thus poor durability performances. On the other hand, pre-treatment compositions B and C (Tg−3° C. and +7° C.), when applied onto the media, mix adequately with inkjet composition, form a durable film and result thus on printed media having good durability and good printing performance.

The preceding description has been presented only to illustrate and describe embodiments of the present invention. Although certain example methods, compositions and articles of manufacture have been described herein, the scope of coverage of this patent is not limited thereto. On the contrary, this patent covers all methods, compositions and articles of manufacture fairly failing within the scope of the claims either literally or under the doctrine of equivalents.

The invention claimed is:

1. A printing method for producing durable images comprising:

a. applying a pre-treatment composition onto a recording medium, said pre-treatment composition comprising a liquid vehicle, a polyvalent metal salt as a fixing agent, and a latex resin having a glass transition temperature ranging from −22° C. to 20° C.; and b. applying an ink composition, comprising an aqueous liquid vehicle and a colorant, over said pre-treatment composition, wherein the ink composition is applied while the pre-treatment composition is still wet on the recording medium;

wherein a time interval between a finishing point of the application of the pre-treatment composition and a starting point of the application of the ink composition is between 1 second and 30 seconds.

2. The printing method of claim 1 wherein the time interval between the finishing point of the application of the pre-treatment composition and the starting point of the application of the ink composition is between 5 seconds and 30 seconds.

3. The printing method of claim 1 wherein a print speed of the method is between about 50 feet per minute (fpm) and about 400 fpm.

4. The printing method of claim 1 wherein a print speed of the method is between about 50 fpm and about 200 fpm and wherein the time interval between the finishing point of the application of the pre-treatment composition and the starting point of the application of the ink composition is between 5 seconds and 30 seconds.

5. The printing method of claim 1 wherein the pre-treatment composition is applied, onto said recording medium, using coating devices and wherein the ink composition is jetted, onto said recording medium, via inkjet nozzles.

6. The printing method of claim 1 wherein the glass transition temperature of the latex resin in the pre-treatment composition ranges between −3° C. and +7° C.

7. The printing method of claim 1 wherein the pre-treatment composition comprises the latex resin in an amount representing from about 10 wt % to about 60 wt % of a total weight of the pre-treatment composition.

8. The printing method of claim 1 wherein the pre-treatment composition comprises, as the fixing agent, the polyvalent metal salt selected from the group consisting of calcium chloride, calcium nitrate, magnesium nitrate, magnesium acetate and zinc acetate.

9. The printing method of claim 1 wherein the pre-treatment composition comprises, as the fixing agent, calcium chloride or calcium nitrate.

10. The printing method of claim 1 wherein the recording medium is plain paper, and wherein the pre-treatment composition is applied directly on the plain paper.

11. The printing method of claim 1 wherein the recording medium is a non-porous medium, and wherein the pre-treatment composition is applied directly on the non-porous medium.

12. The printing method of claim 1 wherein the latex resin in the pre-treatment composition has an acid number of less than 20.

* * * * *